US006684821B2

(12) United States Patent
Lannes et al.

(10) Patent No.: US 6,684,821 B2
(45) Date of Patent: Feb. 3, 2004

(54) ENERGY SUSTAINING WATER HEATER

(75) Inventors: Eric M. Lannes, Kentwood, MI (US); Garrett Doss, Wyoming, MI (US)

(73) Assignee: Bradford White Corporation, Ambler, PA (US)

( * ) Notice: Subject to any disclaimer, the term of this patent is extended or adjusted under 35 U.S.C. 154(b) by 0 days.

(21) Appl. No.: 10/044,709

(22) Filed: Oct. 24, 2001

(65) Prior Publication Data

US 2003/0075118 A1 Apr. 24, 2003

(51) Int. Cl.[7] ..... F22B 5/04
(52) U.S. Cl. ..... 122/14.2; 122/4 A; 431/80
(58) Field of Search ..... 122/13.01, 14.2, 122/14.21, 4 A, 14.31, 19.1, 19.2; 126/344; 431/80

(56) References Cited

U.S. PATENT DOCUMENTS

| | | | | | |
|---|---|---|---|---|---|
| 3,831,582 A | * | 8/1974 | Mahoney | 431/20 |
| 4,131,413 A | | 12/1978 | Ryno | 431/44 |
| 4,408,593 A | | 10/1983 | Furumoto et al. | 126/85 |
| 4,565,519 A | | 1/1986 | Carignan | 431/46 |
| 4,717,333 A | | 1/1988 | Carignan | 431/51 |
| 5,393,221 A | * | 2/1995 | McNally | 122/13.01 |
| 5,816,791 A | | 10/1998 | Home | 431/46 |
| 5,911,217 A | * | 6/1999 | Dameworth et al. | 126/244 |
| 6,257,871 B1 | | 7/2001 | Weiss et al. | 431/20 |
| 6,261,087 B1 | | 7/2001 | Bird et al. | 431/80 |

* cited by examiner

*Primary Examiner*—Gregory Wilson
(74) *Attorney, Agent, or Firm*—RatnerPrestia

(57) ABSTRACT

The present invention is directed to a water heater that sustains energy during the standby mode so that it can power energy saving devices while e minimizing energy loss and controlling the stored water temperature. The present invention may include an outer casing, an insulated tank containing flue tubes, a combustion chamber, a burner rack containing a pilot and thermopile assembly, a flue collector, a damper and a draft diverter. These components are preferably arranged to enable heat from the main burners to be transferred in an efficient manner to the water when needed and heat loss from the water to be minimized when the main burners are not fired. This may be accomplished without the use of external electric power, and the energy producing and heat transferring components of the water heater are optimally balanced, resulting in a sustained energy level that minimizes heat loss, prevents unwanted increases in water temperature, and enables the use of a damper without external electrical power.

33 Claims, 2 Drawing Sheets

ENERGY SUSTAINING WATER HEATER

BACKGROUND OF THE INVENTION

1. Field of the Invention

The present invention relates to a gas water heater. More particularly, the present invention relates to an energy sustaining water heater. Even more particularly, the present invention relates to the use of thermo-voltaic devices to control water temperature and energy loss.

2. Description of the Prior Art

Today's commercial water heaters are produced to some of the most rigorous energy and safety standards in the world. Unfortunately, these standards have prohibited commercial water heaters from utilizing industry proven continuous pilot technology without the use of external power. This single limitation requires installers to provide external power at elevated first cost and this external power prohibits the water heater from operating when the external power is interrupted.

The inadequacies of the prior art are exemplified in, for example, U.S. Pat. No. 4,131,413 to Ryno. The Ryno patent discloses a self-contained electric igniter with a rechargeable battery in which the ignition pilot is actuated by the rechargeable battery to supply energy for the spark provided by the igniter. The energy for opening the main gas valve is supplied by a thermopile generator, which charges the battery. However, the damper control system is operated by a complicated mechanical linkage and piston, which is actuated when gas passes through the gas conduit. Such mechanical dampers have the significant disadvantage that they are unreliable and allow for overheating of the water.

This problem has typically been solved in the systems of the prior art through the use of electric motors to actuate the flue damper. However, these electric motors require external power, as noted above. This has the significant disadvantage that the flue damper will not operate if power is interrupted to the water heater, and consequently, hot water cannot be provided; and water temperature and energy loss cannot be controlled.

Accordingly, an improved water heater is needed in which energy can be sustained within the water heater to allow for the reliable operation of the water heater even in the event of a power failure.

SUMMARY OF THE INVENTION

The present invention is directed to a water heater that sustains energy during the standby mode so that it can power energy saving devices while minimizing energy loss and controlling the stored water temperature. The present invention may include an outer casing, an insulated tank containing flue tubes, a combustion chamber, a burner rack containing a pilot and thermopile assembly, a flue collector, a damper and a draft diverter. These components are preferably arranged to enable heat from the main burners to be transferred in an efficient manner to the water when needed and to enable heat loss from the water to be minimized when the main burners are not fired.

Moreover, this may be accomplished without the use of external electric power, because the water heater sustains the energy needed to power the damper while in the standby mode. The energy producing and heat transferring components of the water heater are optimally balanced, resulting in a sustained energy level that minimizes heat loss, prevents unwanted increases in water temperature, and enables the use of a damper without external electrical power.

DETAILED DESCRIPTION OF THE PREFERRED EMBODIMENT

The present invention is best understood from the following detailed description of the preferred embodiment, when read in connection with the accompanying figures and the appended claims. Although the invention is described with reference to exemplary embodiments, it is not limited to those embodiments. Rather, the appended claims should be construed to include other variant embodiments of the invention, which may be made by those skilled in the art without departing from the spirit and scope of the invention.

The present invention provides the significant advantage over the systems of the prior art that the standby loss levels that were previously only obtainable by the use of external electrical power can now be obtained without external electrical power. Moreover, the system of the present invention has been designed in conjunction with the damper so that the heat produced by the pilot burner does not increase water temperature while keeping standby losses at a minimum.

Figure 1:
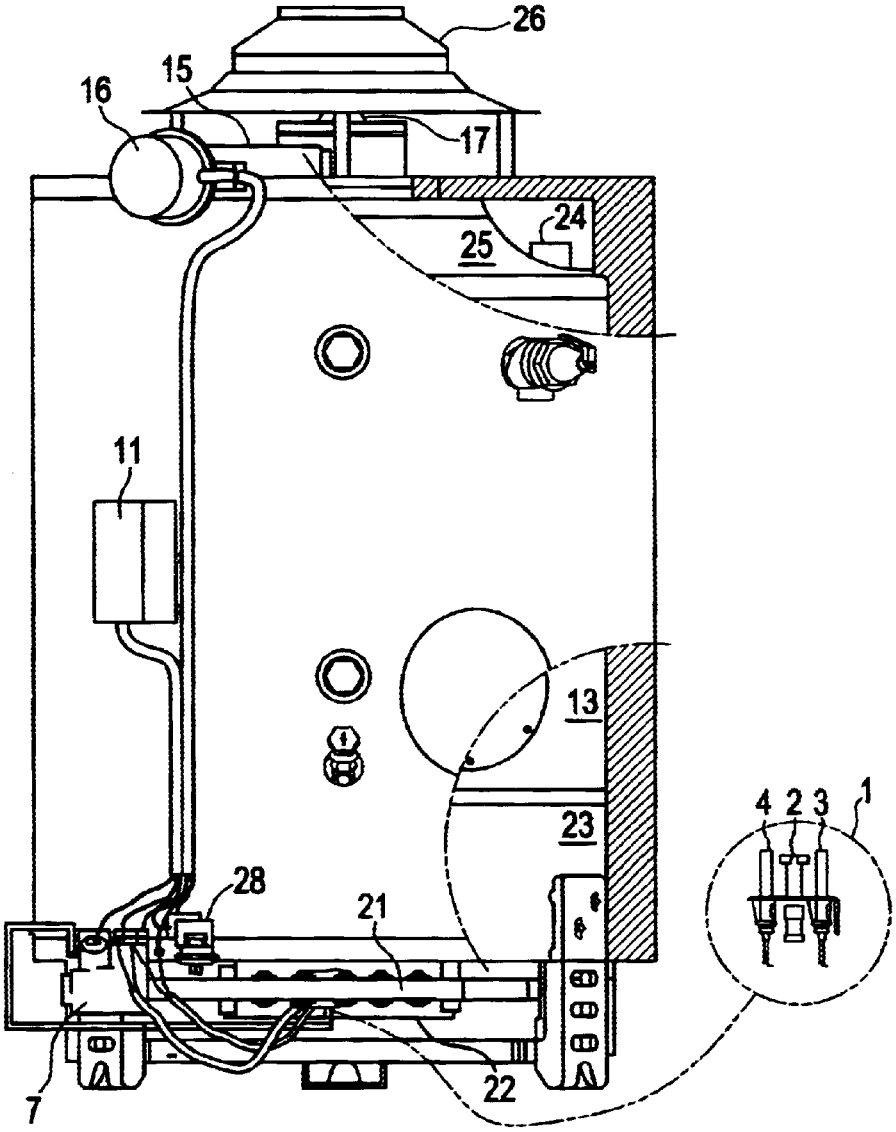
FIG. 1 is an elevation and cross-section illustrating a gas water heater incorporating a preferred embodiment of the present invention.
Figure 2:
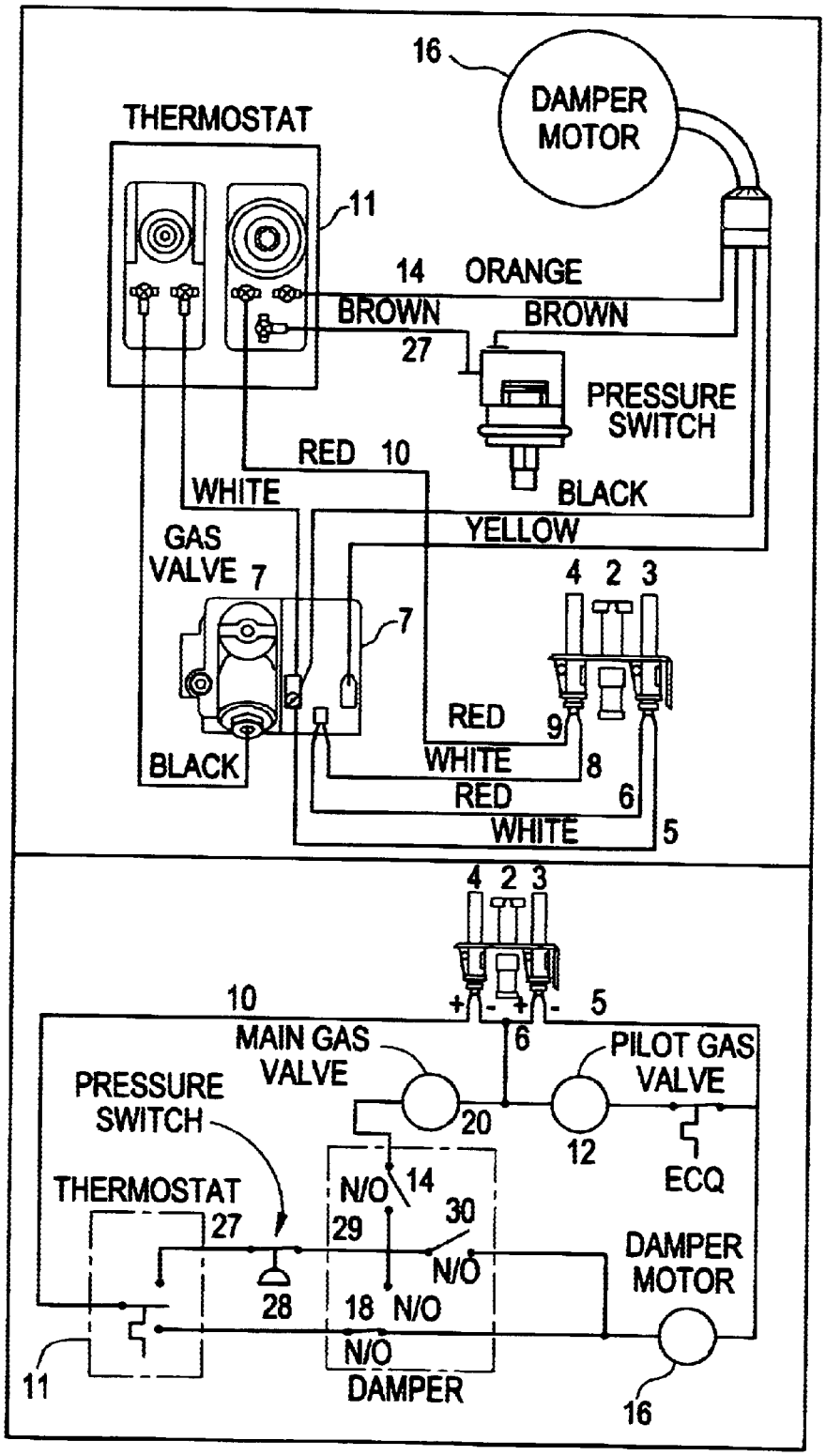
FIG. 2 is a schematic illustrating the electrical connection of the preferred embodiment of the present invention.

The preferred embodiment of the invention is illustrated in FIGS. 1 and 2. Referring to FIGS. 1 and 2, the pilot and thermopile assembly 1 of the preferred embodiment of the present invention consists of a pilot burner 2 and two thermo-voltaic devices 3 and 4 located proximally thereto. Pilot burner 2 is lit in a conventional manner when the water heater is brought into operation. The pilot flame from pilot burner 2, which may or may not being contact with thermo-voltaic devices 3 and 4, provides heat energy to thermo-voltaic devices 3 and 4, which thereby create the electrical energy.used in the system of the present invention. Thermo-voltaic devices 3 and 4 preferably comprise thermopiles, but are not necessarily limited thereto. The operation of thermopiles is well known to those of ordinary skill in the art and will not be further elaborated upon here except to note the voltage produced by thermo-voltaic devices 3 and 4 is preferably in the milli-volt (mV) range.

While two thermopiles are shown in the preferred embodiment, those of ordinary skill in the art will appreciate that more or less thermopiles may be used depending on the voltage and current required and the performance characteristics of thermopiles used. However, by using two thermopiles in the manner illustrated, the output from a single pilot burner is maximized while keeping the overall size of the pilot assembly to a minimum.

Thermo-voltaic devices 3 and 4 are preferably, but not necessarily wired in series. Lead wires 5 and 6 for thermo-voltaic device 3 are connected to the gas valve 7 and the lead wires 8 and 9 for the thermo-voltaic device 4 are connected to the gas valve 7, and Wire 10 is connected to the thermostat 11 to provide power thereto, as shown. Thermo-voltaic device 3 supplies the power needed to hold open the pilot valve 12 located in the gas valve 7. The pilot 2 remains lit the entire time that the water heater is in operation.

Thermostat 11 is preferably located in an opening on tank 13 to measure the temperature of the water in tank 13. The type of thermostat used for thermostat 11 is not particularly limited and may comprise one of a number of conventional thermostats, such as bimetallic or thermocouple based thermostats, the operation of which is well known in the art. When thermostat 11 detects the need to heat the water, it closes the circuit between wire 10 supplying power to the thermostat 11 from thermo-voltaic devices 3 and 4 and wire 14 leading from thermostat 11 to damper 15. As a result of this completed circuit, power is delivered to damper motor 16, causing damper vane 17 to move into the full open vertical position.

When damper vane 17 reaches the full open vertical position, switches 18 and 19 are actuated. Switch 18 opens the circuit providing power to the motor and acts in series with switch 19 to complete a circuit providing power to main gas valve 20. Main gas valve 20 then opens supplying gas through manifold 21 to the main burners 22 in a conventional manner, and main burners 22 are ignited by the pilot flame. The gas is burned in the combustion chamber 23. The products of combustion rise through the flue tubes 24, collector 25, and opened flue damper 15. The combustion products then exit the water heater through draft diverter 26 into the installation's venting system (not shown).

When the temperature of the water in the tank reaches the set point of thermostat 11, thermostat 11 switches, opening the circuit between wire 10 supplying power to the thermostat and wire 14 leading to damper 15, and closing the circuit between wire 10 supplying power to the thermostat and wire 27 connected to pressure switch 28. When power is interrupted in the circuit leading to damper 15, the power to main gas valve 20 is interrupted.

When the gas is no longer flowing through manifold 21, pressure switch 28 closes, completing a circuit between thermostat 11 and wire 29 leading to damper 15. The completion of this circuit supplies power to damper motor 16 so that damper vane 17 moves to the closed position. When damper vane 17 moves to the closed position, switch 30 opens, interrupting power to damper motor 16.

The damper preferably remains closed while the water heater is in standby, reducing energy loss from the water heater. Pilot burner 2 continues to burn so that the energy is available for another cycle when the water in the tank 13 becomes cold enough to again activate the thermostat 11, without the need for an external source of power to operate damper motor 16. The present invention thereby achieves the significant advantage of enabling proven standing pilot technology to operate safely and reliably on the commercial water heaters of today without the use of external power.

As discussed above, the present invention generates power from the use of thermopiles positioned in the pilot flame. The pilot flame is also controlled so it can maximize the thermopile output voltage and prevent the stored water from increasing in temperature to an unsafe level. In the preferred embodiment of the present invention, this is preferably accomplished through the use of a specially sized orifice that limits the flow rate to pilot burner 2. The use of the sized orifice to limit flow rate, coupled with the use of an integral damper upstream of the draft hood, provides a controlled balance of the water temperature and sufficient energy for the gas valve to operate.

The pilot orifice is preferably sized so that the amount of energy generated is capable of operating the damper, but small enough to allow the use of a flue damper on the water heater. Keeping the pilot input at a minimum allows the relief area for the flue damper on the water heater to be as small as possible.

The relief area is required to prevent build up of tank temperature when the water heater is in the standby mode. Extensive testing has determined the correct amount of relief area. The proper amount of relief area results in minimal standby loss while preventing water temperatures in the water heater tank from exceeding an acceptable level. Keeping the relief area to a minimum is a significant factor in the effectiveness of the damper in reducing standby loss.

Another important function of the relief area is to reduce the amount of torque required to turn the damper vane. When the relief area consists of an air gap or softer materials, the resistance from having the damper vane rub against the outer ring of the damper is eliminated or at least substantially reduced. When the amount of torque required to turn the damper is reduced, the damper requires less energy to turn, which allows the pilot input to be kept at a minimum, since less energy must be generated by the thermopiles.

It is also preferred to put redundancy into the safety circuit with a control system that can only use the energy produced by the pilot for operation. By installing a pressure switch on the manifold of the water heater some redundancy may be added to the safety circuit without increasing the energy needed to operate the control system. The pressure switch is a normally closed switch that opens when there is gas pressure in the manifold. When the thermostat is satisfied, it de-energizes the gas valve, causing it to close and switch the energy circuit that closes the damper. The pressure switch will not allow this circuit to be completed until the gas manifold has depressurized. In this way, the pressure switch can prevent the damper from closing while the main burners are still firing.

The present invention has the significant advantage over the systems of the prior art that the power generation from the standing pilot provides sufficient energy to operate the damper to substantially reduce the heat loss from the storage tank when main burners 22 are not operating, while also providing sufficient power to operate a gas valve for providing gas to the main burner(s). The stored water is thereby prevented from reaching undesirable temperatures during the no-burner operating times.

Because of the use of low voltage thermopile, the safety circuits can be installed in series with the thermopile system to insure the water heater operates when it is called upon to operate, and the damper opens before the main burner(s) operate to prevent heat spillage from the combustion chamber. The damper is opened and remains open during main burner(s) operation, and is closed to reduce the heat loss during no-burner operating times without any external power.

The present invention provides an uninterrupted supply of hot water while satisfying the most stringent energy loss requirements in the United States. The present invention reduces the installation time required, substantially reduces the first cost for installation and provides the same amount of hot water as current externally powered products provide, all without sacrificing safety. In fact, the safety circuit of the present invention prevents the possibility of false signals often found with external powered systems, because this new system is designed around industry proven mechanical switching systems.

While in the standby mode, the pilot burns gas at a rate that is sufficient to sustain the energy required to operate the damper and gas valve. When the thermostat calls for heat, the damper opens up and allows the gas valve to open after the damper is proved to be opened. The gas flows to the main burner(s) and the combustion products flow through the flue tubes heating the water. The combustion gases exit through the flue collector and damper into the draft diverter, which is connected to the vent system. When the thermostat is satisfied the burners are shut off and the damper closes once it is proven that the gas valve has closed. The water heater continues to operate at the sustained energy level until the next call for operation by the thermostat. While operating at the sustained energy level the temperature of the water in the tank does not go beyond acceptable levels.

Although this invention has been described with reference to particular embodiments, it will be appreciated that many variations may be resorted to without departing from the spirit and scope of this invention. For example, the hot water tank may have single flue tube, with the damper sitting on the flue tube; a collector for the flue products would not be necessary. In addition, there could be a single burner, instead of the multiple main burners described herein. The orifice that restricts airflow at the combustion air inlet to the water heater may also be used instead of a flue damper.

We claim:

1. A water heater comprising:

a tank for storing water;

a combustion chamber in thermal communication with said tank for heating said water, said combustion chamber containing a pilot burner and at least one main burner;

a flue containing a flue damper to control the passage of exhaust gases from said combustion chamber; and an electrical control circuit, said electrical control circuit including a thermo-voltaic device proximal to said pilot and said control circuit being connected to said flue damper; wherein said control circuit is capable of using thermal energy from said pilot to generate electrical power to operate said damper and to balance heat loss from the water in said water heater when said main burners are not fired.

2. The water heater of claim 1, wherein said thermo-voltaic device comprises a plurality of thermopiles.

3. The water heater of claim 2, wherein said plurality of thermopiles are each in the milli-volt range.

4. The water heater of claim 2, wherein said thermopiles are connected in series.

5. The water heater of claim 1, wherein said flue comprises flue tubes and a flue tube collector.

6. The water heater of claim 1, further comprising a draft diverter.

7. The water heater of claim 1, wherein said pilot burner and said damper are capable of balancing standby heat loss against water temperature.

8. The water heater of claim 1, further comprising a pressure switch connected to prevent said flue damper from closing while said main burner is firing.

9. A water heater comprising:

a tank for storing water;

a combustion chamber for heating said water, said combustion chamber having a pilot and at least one main burner;

a flue and flue damper for controlling the passage of exhaust gases from said combustion chamber; and an electrical control circuit, said electrical control circuit having a thermo-voltaic device proximal to said pilot burner;

wherein said electrical control circuit is connected to control the transfer of heat from said main burner to said water when said main burner is fired, and to control heat loss from said water when said main burner is not fired using said thermo-voltaic device.

10. The water heater of claim 9, wherein said thermo-voltaic device comprises a plurality of thermopiles.

11. The water heater of claim 10, wherein said plurality of thermopiles are each in the milli-volt range.

12. The water heater of claim 10, wherein said thermopiles are connected in series.

13. The water heater of claim 9, wherein said flue comprises flue tubes and a flue tube collector.

14. The water heater of claim 9, further comprising a draft diverter.

15. The water heater of claim 9, wherein said pilot burner and said damper are capable of balancing standby heat loss against water temperature.

16. The water heater of claim 9, further comprising a pressure switch connected to prevent said flue damper from closing while said main burner is firing.

17. In a method for sustaining energy in a water heater having a tank for storing water, a combustion, chamber having a pilot and at least one main burner, a flue and flue damper for controlling the passage of exhaust gases from said combustion chamber; and an electrical control circuit having a thermo-voltaic device; said method comprising using said thermo-voltaic device to controlling the transfer of heat from said main burner to said water when said burner is fired and controlling heat loss from said water when said main burner is fired.

18. The method of claim 17, wherein said pilot burner and said damper are used to balance standby heat loss against water temperature.

19. The method of claim 17, wherein a pressure switch is used to prevent said flue damper from closing while said main burner is firing.

20. A water heater comprising:

a tank for storing water;

a combustion chamber in thermal communication with said tank for heating said water, said combustion chamber containing a pilot burner and at least one main burner;

a flue containing a flue damper to control the passage of exhaust gases from said combustion chamber;

a thermo-electric source, said thermo-electric source comprising a plurality of thermo-voltaic devices arranged proximal to said pilot burner to use thermal energy from said pilot to generate electrical power;

an electrical control circuit, said electrical control circuit being connected to said thermo-electric energy source and said flue damper;

wherein said control circuit is configured to operate said damper using said electrical power from said thermo-electric source to balance heat loss from the water in said water heater when said main burners are not fired.

21. The water heater of claim 20, wherein said plurality of thermo-voltaic devices are each in the milli-volt range.

22. The water heater of claim 20, wherein said thermo-voltaic devices are connected in series.

23. The water heater of claim 20, wherein said thermo-voltaic devices comprise thermopiles.

24. The water heater of claim 20, wherein said plurality of thermo-voltaic devices comprise two thermopiles positioned substantially equidistant from said pilot burner on opposite sides thereof.

25. A water heater power source for an electrically operable water heater having a water tank, a main burner, and a flue containing a flue damper comprising:

a pilot burner for receiving a combustible gas to produce a flame generating thermal energy;

a thermo-electric source comprising a plurality of thermo-voltaic devices electrically connected together and positioned substantially equidistant from said pilot burner on opposite sides thereof to receive said thermal energy from said pilot burner and to generate electrical power therefrom for operating said water heater.

26. The water heater power source of claim 25, wherein said plurality of thermo-voltaic devices are each in the milli-volt range.

27. The water heater power source of claim 25, wherein said plurality of thermo-voltaic devices are connected in series to operate said water heater.

28. The water heater power source of claim 25, wherein said plurality of thermo-voltaic devices comprise thermo-piles.

29. The water heater power source of claim 25, further comprising an electrical control circuit, said electrical control circuit being connected to said plurality of thermo-electric energy source and said flue damper; wherein said control circuit is configured to operate said flue damper using said electrical power from said thermo-electric source to balance heat loss from the water in said water heater when said main burner is not fired.

30. A water heater pilot assembly for an electrically operable water heater comprising:

a pilot burner for receiving a combustible gas to produce a flame generating thermal energy;

a thermo-electric source comprising a plurality of thermopiles positioned substantially equidistant from said pilot burner on opposite sides thereof to receive said thermal energy from said pilot burner and to generate electrical power therefrom for operating said water heater.

31. The water heater pilot assembly of claim 30, wherein said plurality of thermo-voltaic devices are each in the milli-volt range.

32. The water heater pilot assembly of claim 30, wherein said plurality of thermo-voltaic devices are connected in series to operate said water heater.

33. The water heater pilot assembly of claim 30, further comprising at least one electrical connection to an electrical control circuit, said electrical control circuit being connected to said plurality of thermo-electric energy source and said electrically operable water heater; wherein said control circuit is configured to operate said water heater using said electrical power from said thermo-electric source to balance heat loss from the water in said water heater.

* * * * *

UNITED STATES PATENT AND TRADEMARK OFFICE

CERTIFICATE OF CORRECTION

PATENT NO. : 6,684,821 B2
DATED : February 3, 2004
INVENTOR(S) : Lannes et al.

It is certified that error appears in the above-identified patent and that said Letters Patent is hereby corrected as shown below:

Title Page,
Item [57], ABSTRACT,
Line 3, please delete "e".

Column 6,
Line 18, please delete "," after the word "combustion".
Line 23, please delete "controlling" and insert -- control --.

Signed and Sealed this

Twenty-second Day of June, 2004

JON W. DUDAS
*Acting Director of the United States Patent and Trademark Office*